US007127841B1

(12) United States Patent
Weber

(10) Patent No.: US 7,127,841 B1
(45) Date of Patent: Oct. 31, 2006

(54) COMMUNICATIONS DEVICE AND METHOD FOR USING THE COMMUNICATIONS DEVICE TO COMMUNICATE A MESSAGE

(75) Inventor: Richard L. Weber, 638 Perimeter Dr., Downington, PA (US) 19335

(73) Assignee: Richard L. Weber, Downington, PA (US)

( * ) Notice: Subject to any disclaimer, the term of this patent is extended or adjusted under 35 U.S.C. 154(b) by 0 days.

(21) Appl. No.: 10/665,504

(22) Filed: Sep. 22, 2003

Related U.S. Application Data

(60) Provisional application No. 60/411,752, filed on Sep. 19, 2002.

(51) Int. Cl.
*G09F 1/00* (2006.01)

(52) U.S. Cl. ..... 40/124.03; 704/201

(58) Field of Classification Search ..... 40/124.11, 40/455, 124.03; 379/75, 76, 88.28; 704/201, 704/272; 446/147; 283/117
See application file for complete search history.

(56) References Cited

U.S. PATENT DOCUMENTS

| | | | | |
|---|---|---|---|---|
| 2,517,115 | A * | 8/1950 | Keily | 283/117 |
| 4,795,195 | A * | 1/1989 | McClain, Jr. | 283/56 |
| 5,063,698 | A | 11/1991 | Johnson et al. | |
| 5,199,745 | A * | 4/1993 | Balsamo | 283/117 |
| 5,275,285 | A | 1/1994 | Clegg | |
| 5,318,327 | A * | 6/1994 | Daneshvar | 283/117 |
| 5,444,767 | A | 8/1995 | Goetcheus et al. | |
| 5,570,414 | A | 10/1996 | Stern | |
| 5,577,918 | A | 11/1996 | Crowell | |
| 5,778,574 | A * | 7/1998 | Reuben | 40/124.03 |
| 5,829,790 | A * | 11/1998 | Phillips | 40/124.11 |
| 5,836,616 | A | 11/1998 | Cooper | |
| 6,028,752 | A * | 2/2000 | Chomette et al. | 40/124.03 |
| 6,185,851 | B1 | 2/2001 | Loudermilk et al. | |
| 6,263,310 | B1 | 7/2001 | Loudermilk et al. | |
| 6,591,523 | B1 * | 7/2003 | Pines | 40/124.03 |
| 6,845,583 | B1 * | 1/2005 | Lee | 40/124.03 |
| 2002/0019776 | A1 | 2/2002 | Simpson | |
| 2002/0105185 | A1 | 8/2002 | Cobb | |
| 2003/0150142 | A1 * | 8/2003 | Street | 40/124.11 |

FOREIGN PATENT DOCUMENTS

| | | | |
|---|---|---|---|
| GB | 2116478 | A * | 9/1983 |

* cited by examiner

*Primary Examiner*—Gary C. Hoge
(74) *Attorney, Agent, or Firm*—Fish & Richardson P.C.

(57) ABSTRACT

Communicating a message using a self-contained communications device includes affixing a customized visual message to the communications device, recording a customized audio message to store on the communications device, storing the customized audio message on the communications device; and playing the customized audio message stored on the communications device.

21 Claims, 16 Drawing Sheets

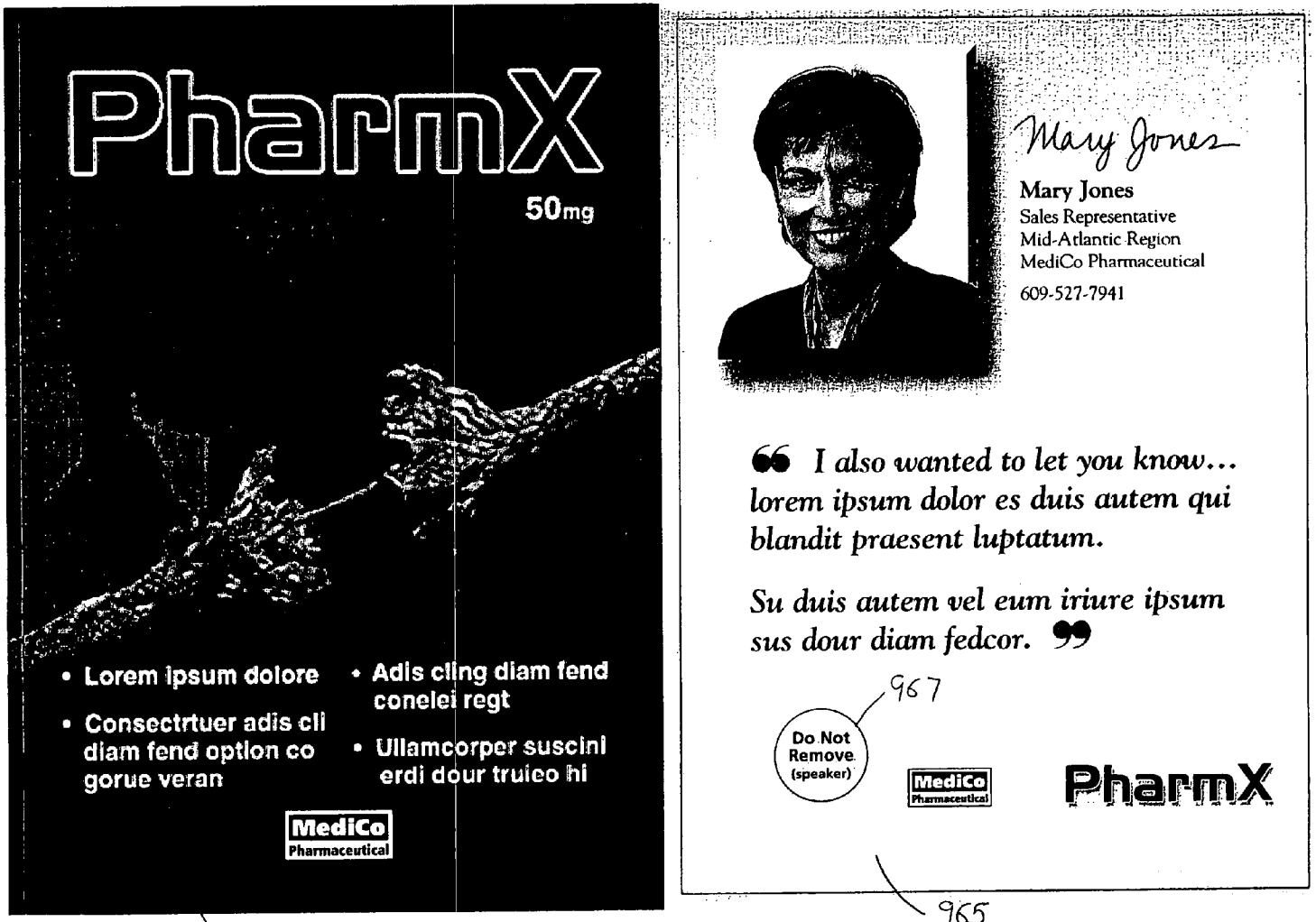
PharmX
50mg
• Lorem ipsum dolore
• Consectruer adis cli diam fend option co gorue veran
• Adis cling diam fend conelei regt
• Ullamcorper suscinl erdi dour truleo hi
MediCo Pharmaceutical
FRONT
960
Mary Jones
Sales Representative
Mid-Atlantic Region
MediCo Pharmaceutical
609-527-7941
I also wanted to let you know... lorem ipsum dolor es duis autem qui blandit praesent luptatum.
Su duis autem vel eum iriure ipsum sus dour diam fedcor.
Do Not Remove (speaker)
967
MediCo Pharmaceutical
PharmX
965
INSIDE
MagicKards
Fig. 9b

1000

(paricalcitol injection)

Fliptop Vial

1010

TABLE OF CONTENTS

DESCRIPTION ..... 2

CLINICAL PHARMACOLOGY ..... 2

1. Mechanism of action ..... 2
2. Pharmacokinetics ..... 2
3. Special Populations ..... 3
4. Clinical Studies ..... 3

INDICATIONS AND USAGE ..... 4

CONTRAINDICATIONS ..... 4

WARNINGS ..... 4

PRECAUTIONS ..... 5

1. General ..... 5
2. Information for the Patient ..... 5
3. Essential Laboratory Tests ..... 5
4. Drug Interactions ..... 5
5. Carcinogenesis, Mutagenesis, Impairment of Fertility ..... 6
6. Pregnancy ..... 6
7. Nursing Mothers ..... 6
8. Pediatric Use ..... 6
9. Geriatric Uses ..... 6

ADVERSE REACTIONS ..... 6

OVERDOSAGE ..... 7

DOSAGE AND ADMINISTRATION ..... 7

HOW SUPPLIED ..... 8

Fig. 10

COMMUNICATIONS DEVICE AND METHOD FOR USING THE COMMUNICATIONS DEVICE TO COMMUNICATE A MESSAGE

CROSS REFERENCE TO RELATED APPLICATIONS

This application claims the benefit of U.S. Provisional Application No. 60/411,752, filed Sep. 19, 2002, and titled "Multimedia Communications Device and Using Multimedia Communication Elements to Enhance Electronic Communications," which is incorporated by reference in its entirety.

TECHNICAL FIELD

This document relates to a communications device and a method for using the communications device to communicate a message.

BACKGROUND

Effective and cost-efficient communications with people can be challenging because of the busy schedules that people maintain. For example, when making a sales call about a product, sales representatives are frequently unable to get their marketing message to the customer because of the customer's busy schedule and because some customers refuse to meet in-person with a sales representative.

SUMMARY

In one general aspect, a communications device includes a panel that has at least a front face and an inside face, and a housing that has a front side, a rear side, and multiple edges, where the panel is affixed to the housing such that the inside face of the panel can be folded flush against the front side of the housing. One or more electronic components are housed within the housing, where the electronic components include a switch that when depressed initiates a recording process to record an audio message, a memory to store the audio message for repeated playing, a processor, a power source, and an input/output audio device to record and play the audio message. An attachment is affixed to the inside face of the panel, where the attachment includes a multiple-page attachment.

Implementations may include one or more of the following features. For example, the panel may be made of card stock. The housing may be made of plastic. The attachment may include a multiple-page booklet that depicts a visual message to provide information about a product. The attachment may include a multiple-page fold-out booklet. The attachment may include a multiple-page fold-out booklet that depicts a visual message to provide information about a product.

A holder may be affixed to the inside face of the panel. The holder may be clear to enable visual perception of an item in the holder. A holder may be affixed to a page of the attachment and the holder may be clear to enable visual perception of an item in the holder. The attachment with the holder affixed to a page of the attachment may include a multiple-page booklet.

In one implementation, the attachment includes a multiple-page fold-out booklet and the holder is affixed to a last page of the booklet and is clear to enable visual perception of an item in the holder.

The communications device may include an activation tab that is affixed to the inside face of the panel such that when the panel is opened away from the housing the activation tab initiates playing of the audio message. A location of the switch may not be visibly perceivable. A template may be used to locate the switch to initiate recording of the audio message.

The housing may include an opening to enable a connector to connect to the processor to transfer an audio message from another device to the processor for storage in the memory.

A visual message may be affixed to the panel and the housing. The visual message may be depicted on one or more labels that are affixed to the panel and the housing. The visual message may be depicted on one or more self adhesive labels that are affixed to the panel and the housing. The visual message may be depicted on one or more cards that are affixed to the panel and the housing.

A visual message may be customized on a computing device and printed on a sheet containing a first self-adhesive label that depicts a first portion of the visual message and that is affixed to the panel and a second self-adhesive label that depicts a second portion of the visual message and that is affixed to the housing.

A first visual message may be depicted on a first self-adhesive label and affixed to the panel and/or the housing and a second visual message may be depicted on a second self-adhesive label and that differs from the first visual message and is affixed over the first self-adhesive label such that the second self-adhesive label may be removed to reveal the first visual message depicted on the first self-adhesive label.

In another general aspect, communicating a message using a self-contained communications device includes affixing a customized visual message to the communications device, recording a customized audio message to store on the communications device, storing the customized audio message on the communications device, and playing the customized audio message stored on the communications device.

Implementations may include one or more of the following features. For example, affixing the customized visual message may include affixing labels on which the customized visual message is depicted to the communications device. Affixing the customized visual message may include affixing self-adhesive labels on which the customized visual message is depicted to the communications device. Affixing the customized visual message may include inserting a card on which the customized visual message is depicted into a holder means on the communications device.

A computer may be used to browse to a website to design the customized visual message and the customized visual message may be printed on self-adhesive labels, where affixing the customized visual message includes affixing the self-adhesive labels to the communications device.

Recording the customized audio message may include recording the customized audio message over a telephone using an interactive voice recording system and transferring the customized audio message to the communications device for storage and playback. Recording the customized audio message may include recording the customized audio message directly into the communications device for storage and playback.

Recording the customized audio message may include using a template to locate a pressure sensitive switch on the communications device and depressing the pressure sensitive switch to initiate recording of the customized audio message directly into the communications device for storage and playback. Recording the customized audio message may include recording the customized audio message using a computing device and transferring the customized audio message to the communications device for storage and playback.

Recording the customized audio message may include recording a first audio message to store on the communications device and recording a second audio message to store on the communications device such that the first audio message and the second audio message are stored on the communications device. Playing the customized audio message may include playing the first audio message and the second audio message stored on the communications device.

In one implementation, a second customized audio message may be recorded that replaces the customized audio message, where the second customized audio message is stored on the communications device is played. The customized audio message may be played multiple times.

In another general aspect, using a self-contained audio recording and playback communications device as a marketing tool includes affixing a visual message to a panel and/or a housing of the communications device, where the visual message includes information about a product and information about a sales representative, recording a customized audio message for storage on the communications device for subsequent hearing by a customer, and delivering the communications device to the customer. Implementations may include one or more of the features discussed above.

In another general aspect, marketing a drug by a sales representative to a doctor using a self-contained audio recording and playback communications device includes customizing a visual message to be affixed to a panel and/or a housing on a communications device, wherein the visual message includes information about the drug and information about the sales representative, recording a customized audio message by the sales representative for storage on the communications device for subsequent hearing by the doctor, and delivering the communications device to the doctor. Implementations may include one or more of the features discussed above.

In another general aspect, communicating a customized visual and audio message from a doctor to a patient using a self-contained audio recording and playback communications device includes customizing a visual message to be affixed to a panel and/or a housing on a communications device, wherein the visual message includes information about a drug and/or a medical condition and information about the doctor, recording a customized audio message by the doctor for storage on the communications device for subsequent hearing by the patient, and delivering the communications device to the patient. Implementations may include one or more of the features discussed above.

In another general aspect, communicating a customized visual and audio message from a gift giver to a gift receiver using a self-contained audio recording and playback communications device includes customizing a visual message to be affixed to a panel and/or a housing on a communications device, wherein the visual message includes information about the gift giver, inserting a gift in a holder that is attached to a front inside face of the panel on the communications device, storing a first audio message on the communications device, recording a customized audio message by the gift giver for storage on the communications device in addition to the first audio message for subsequent hearing by the gift receiver, and delivering the communications device to the gift receiver. Implementations may include one or more of the features discussed above.

These general and specific aspects may be implemented using a system, a method, or a computer program, or any combination of systems, methods, and computer programs.

Other features will be apparent from the description and drawings, and from the claims.

DESCRIPTION OF DRAWINGS

FIGS. 2*a*–2*f* are exemplary diagrams of a panel of the communications device of FIG. 1.

FIG. 10 is an exemplary clinical pamphlet with a table of contents.

Like reference symbols in the various drawings indicate like elements.

DETAILED DESCRIPTION

Figure 1:
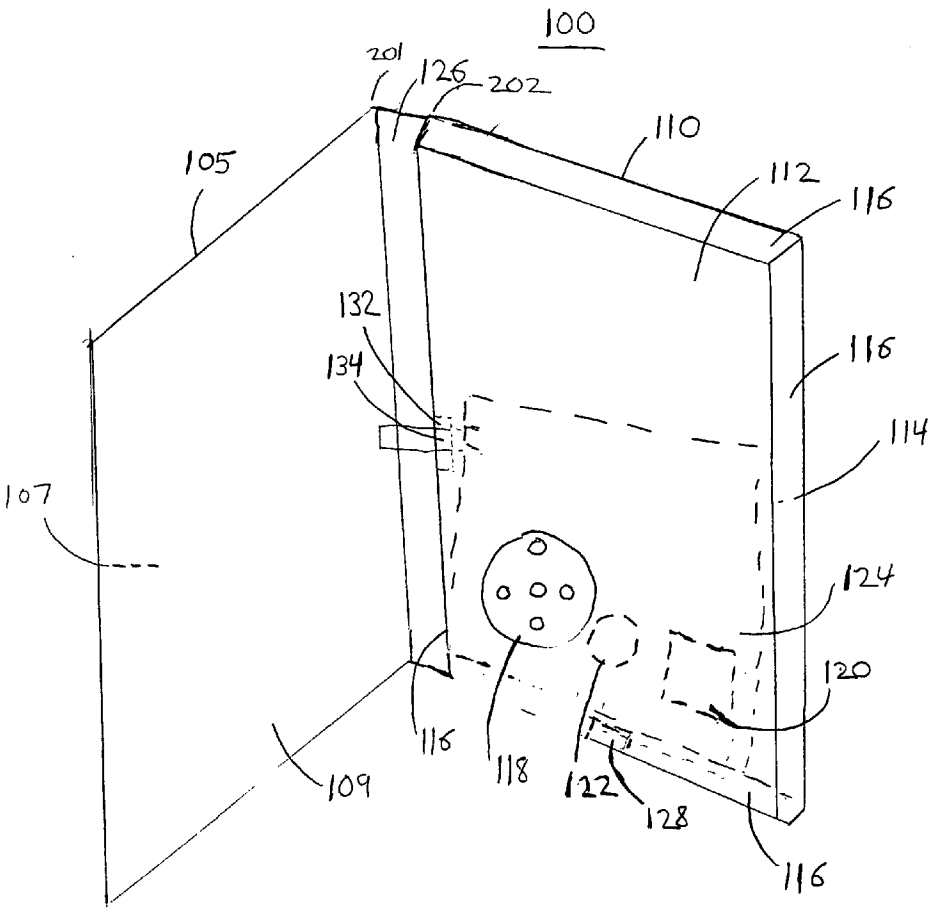
FIG. 1 is an exemplary perspective diagram of an exemplary communications device.

Referring to FIG. 1, a communications device 100 includes a panel 105 that has a front face 107 and an inside face 109. The communications device 100 also includes, a rear face 114, a pivot section 126, and a housing 110. The housing 110 is a multi-sided structure that is defined by a first side 112, a second side 113, and edges 116. The panel 105 is affixed to the housing 110 by the pivot section 126 to form the communications device 100. The panel 105 is attached to the pivot section 126 at a first folding point 201 and the pivot section 126 is attached to the housing 110 at a second folding point 202 such that the panel 105 and the housing 110 open and close to fold apart and together, respectively. Together, the panel 105 and the housing 110 form a card-type structure.

Figure 2A:
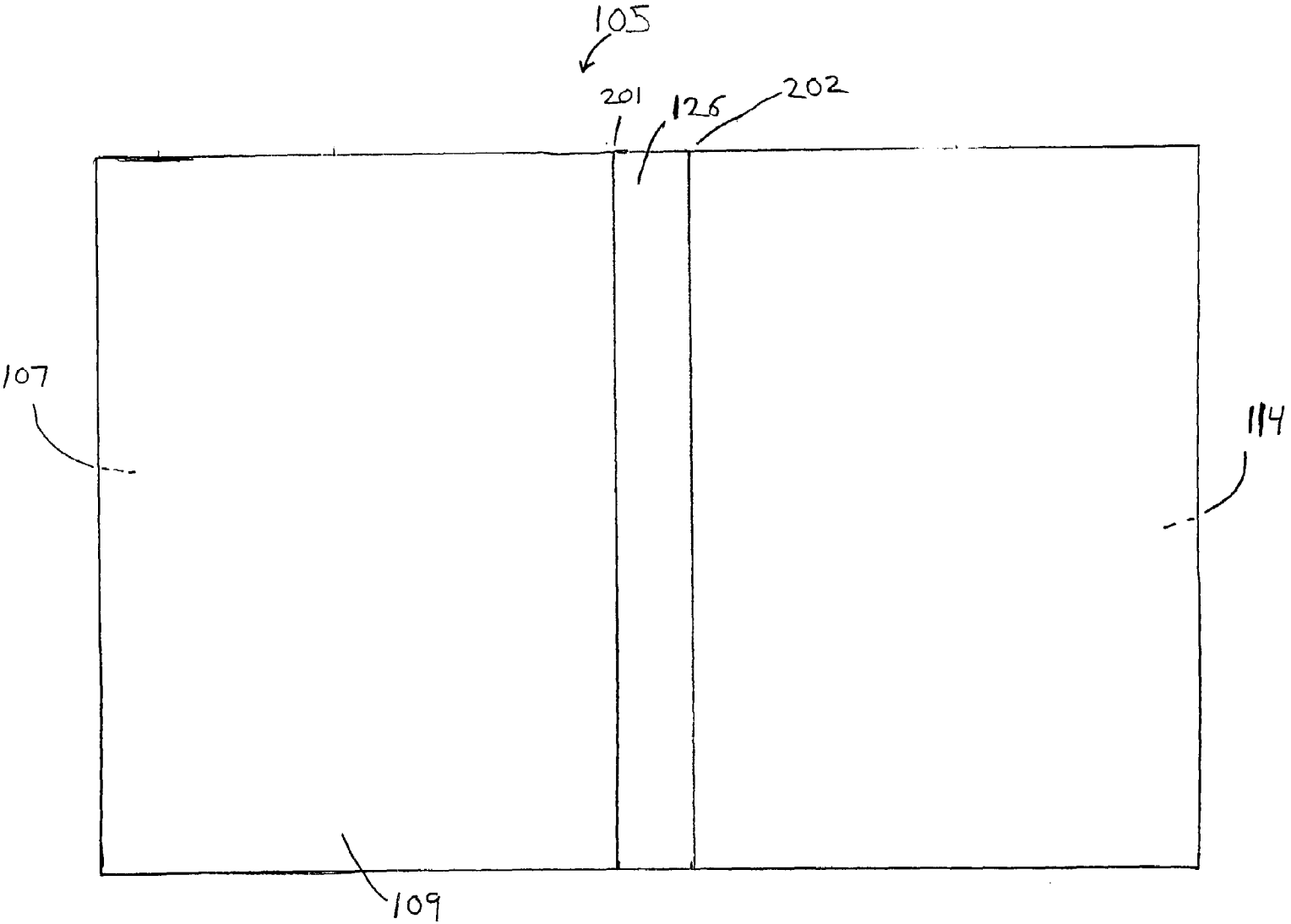

Referring also to FIG. 2*a*, the panel 105 may be constructed of a material that enables other items, such as, for example, labels and self-adhesive labels, to be attached or affixed to the front face 107 and/or to the inside face 109. In one exemplary implementation, the panel 105 may be constructed of a heavy card stock or cardboard-type material. The panel 105, the pivot section 126, and the rear face 114 may be constructed on a single sheet of the heavy card stock or cardboard-type material. The pivot section 126 may be folded at folding points 201 and 202 and/or the folding points 201 and 202 may be pre-scored to enable easy folding.

Figure 2B:
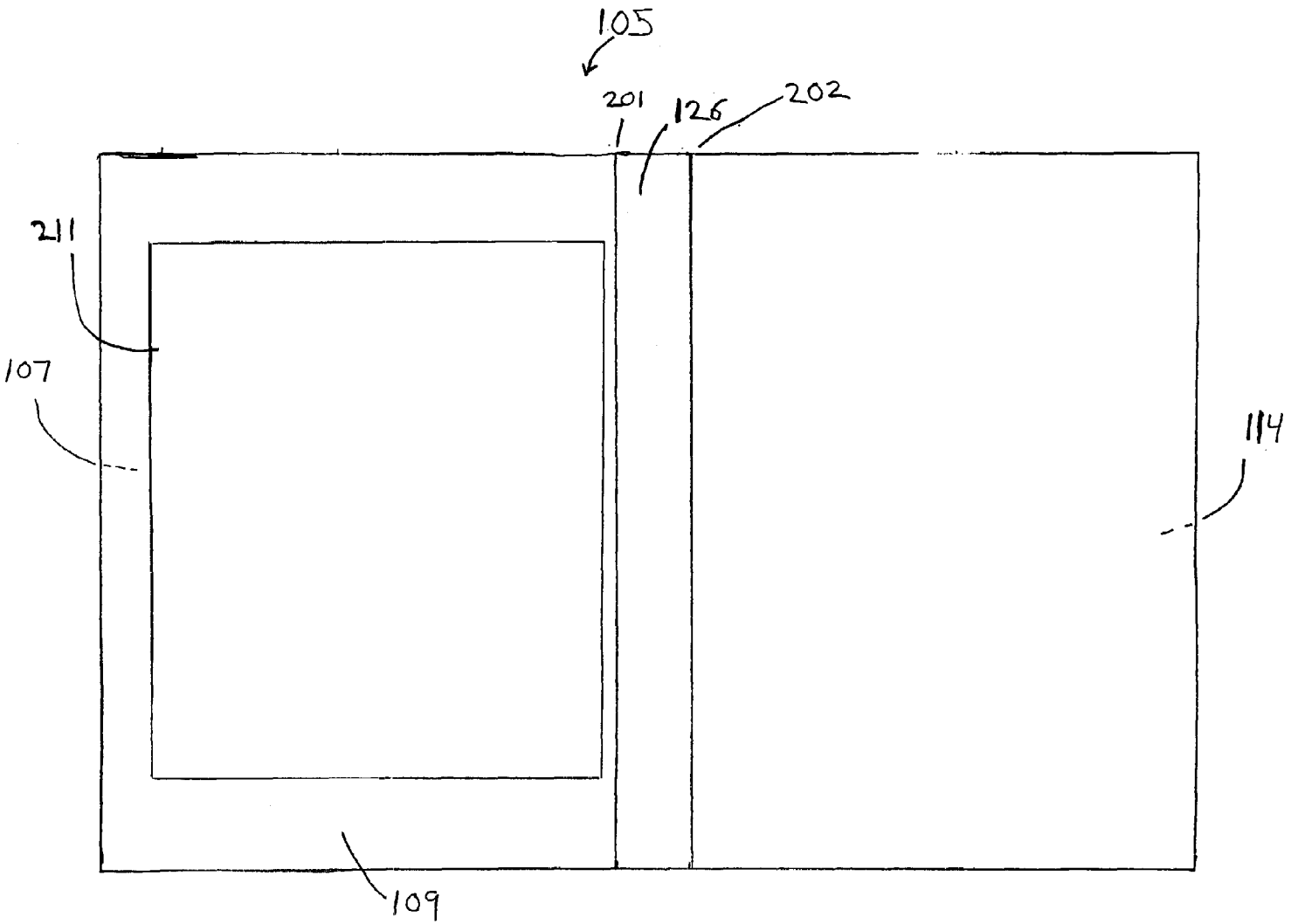

Referring to FIG. 2*b*, in one exemplary implementation, the panel 105 includes an attachment 211 that is affixed to the inside face 109 of the panel 105. The attachment 211 may be affixed by gluing the back of the attachment 211 to inside face 109. Additionally and/or alternatively, the attachment 211 may include a self-adhesive backing that enables the attachment 211 to adhere to the inside face 109. Additionally and/or alternatively, the inside face 109 may include a peel back, self-adhesive label that enables the attachment 211 to be affixed to the inside face 109.

In one implementation, the attachment 211 may include a single sheet of printed material. In another implementation, the attachment 211 may include a multiple page booklet. The pages of the multiple page booklet may be joined at a common edge such that the pages of the booklet open like a card or a book. The multiple page booklet may be a fold-out booklet such that the pages of the booklet open out into a multiple panel fold-out booklet.

Figure 2C:
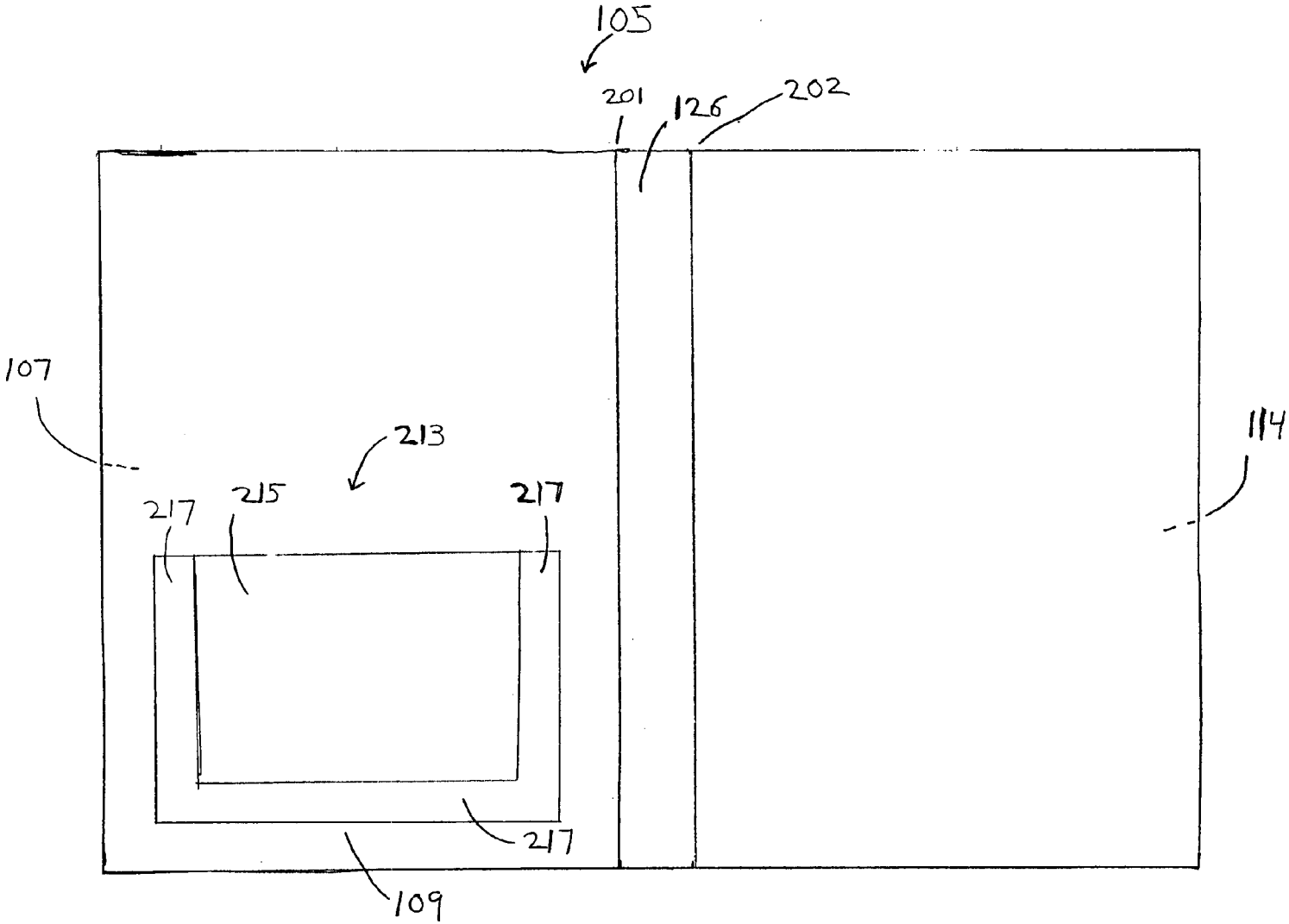

Referring to FIG. 2*c*, in one exemplary implementation, the panel 105 includes a holder 213 affixed to the inside face 109 that is capable of holding different types of items. The holder 213 includes a pocket area 215 that is formed by attaching three of the edges 217 to the inside face 109. The edges 217 of the holder 213 may be attached by a peel-off self-adhesive tape that is on the holder 213 itself or there may be multiple (e.g., three) strips of adhesive tape on the inside face 109 that, when peeled off, enable the edges 217 of the holder 213 to be adhered to the inside face 109. In another implementation, the edges 217 of the holder 213 may be affixed to the inside face 109 by using a glue-like substance, double-sided tape, or another suitable adherent.

Holder 213 may be made of different types of materials. In one exemplary implementation, holder 213 may be made of a clear material (e.g., see-through plastic) such that any item placed in the holder 213 is visually perceivable. In another exemplary implementation, holder 213 may be made of a paper-like material (e.g., heavy paper, flexible cardboard, or card stock) to hold items.

Items that may be held in holder 213 may include, for example, coupons, gift certificates, tickets, notes, pamphlets, brochures, or other types of items and combinations of these items.

Figure 2D:
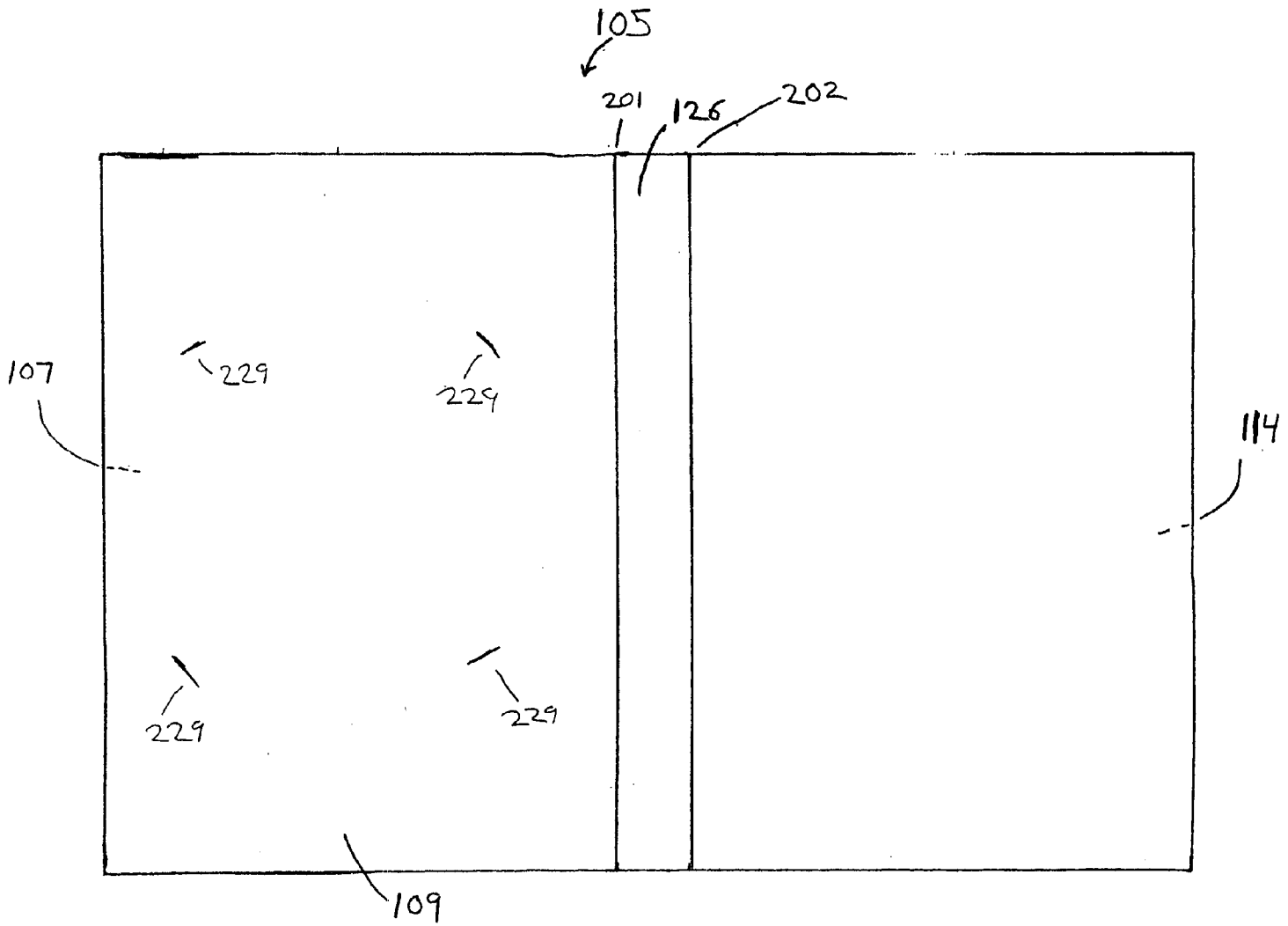
Figure 2E:
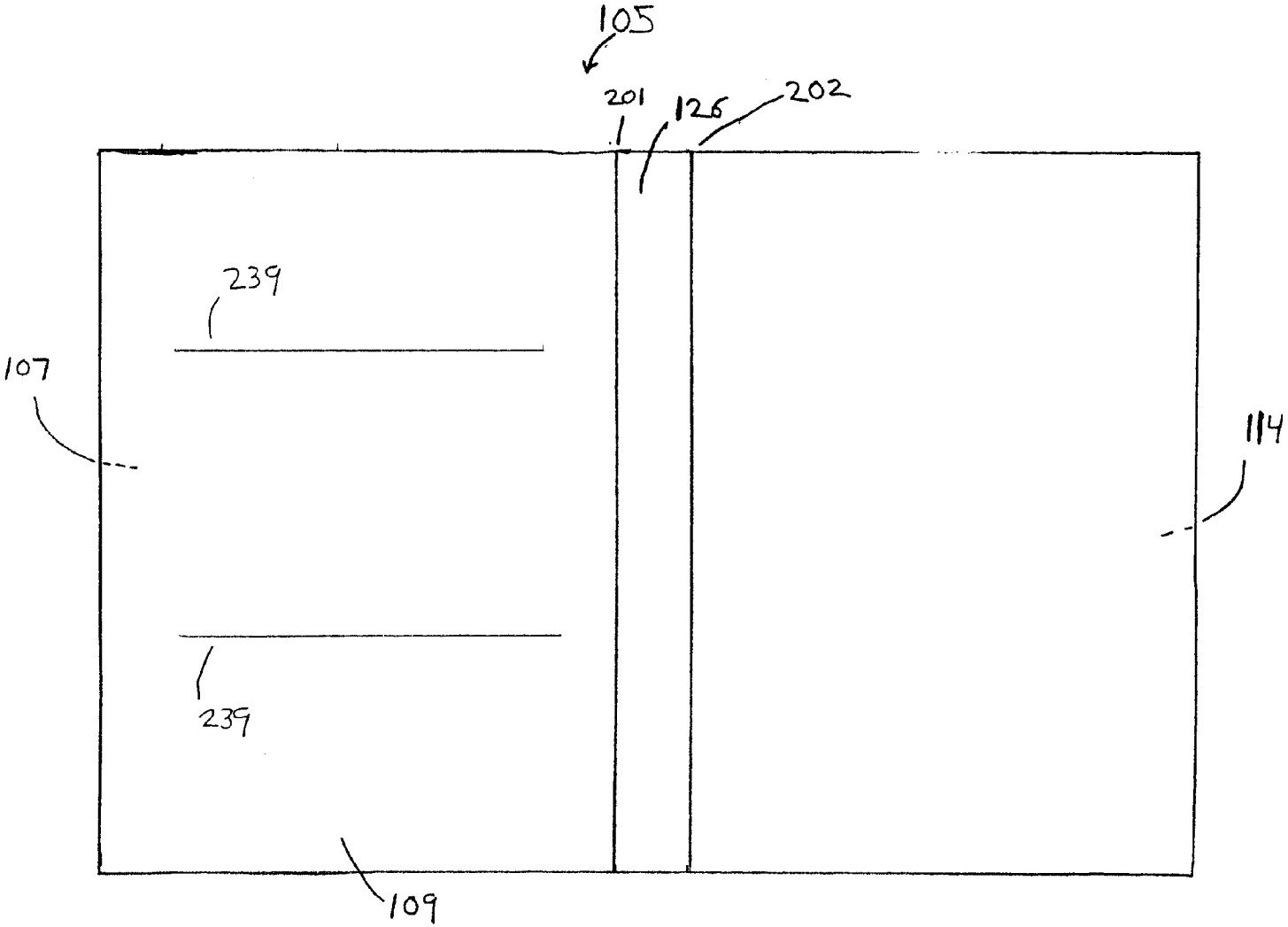
Figure 25:
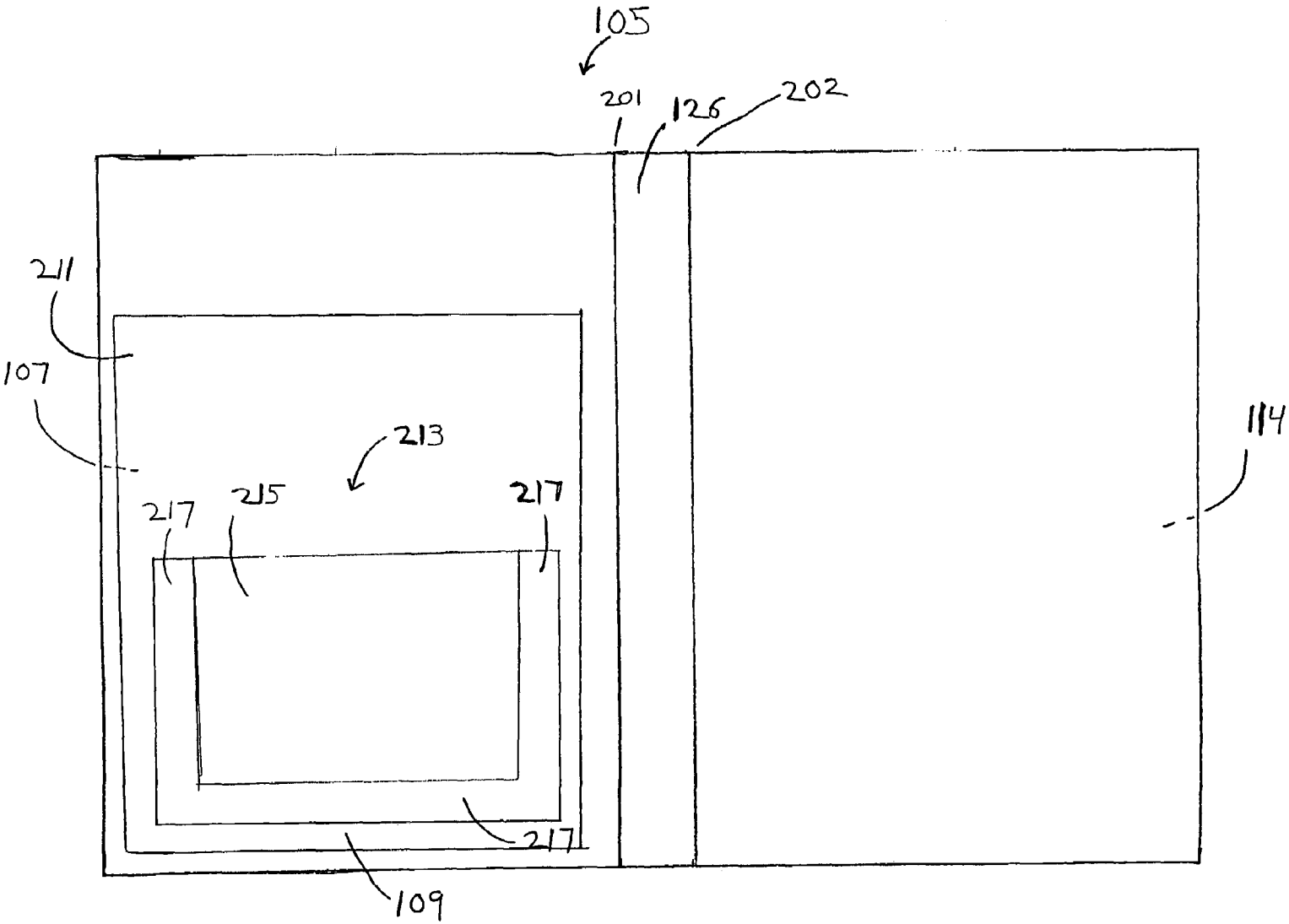

Instead of including a pocket area 215 to secure an item in the communications device 100 as illustrated in FIG. 2*c*, the holder may include other means to secure an item in the communications device 100. Referring to FIG. 2*d*, in one exemplary implementation, the holding means may include one or more slits 229 cut into the inside face 109 of the panel 105. In this example, the corners of the item may be slid into the slits 229 to hold the item in place. Referring to FIG. 2*e*, in one exemplary implementation, the holding means may include one or more horizontal slits 239 cut into the inside face 109 of the panel 105. In this example, one or more of the edges of the item may be slid into the horizontal slits 229 to hold the item in place. Other holding means are also possible including, for example, a frame with multiple sides such that an item may be slid into the frame and secured in the communications device 100.

Referring to FIG. 2*f*, in one exemplary implementation, panel 105 includes a combination of attachment 211 and holder 213. For example, in one implementation, attachment 211 may include a multiple page booklet and the holder 213 may be affixed to the last page of the booklet. In another implementation, attachment 211 may include a multiple page fold-out booklet and the holder 213 may be affixed to the last page of the booklet. In the exemplary implementation, in addition to affixing holder 213 to the last page of attachment 211, the edges 217 of the holder 213 also may be affixed to the inside face 109 of panel 105.

Figure 3:
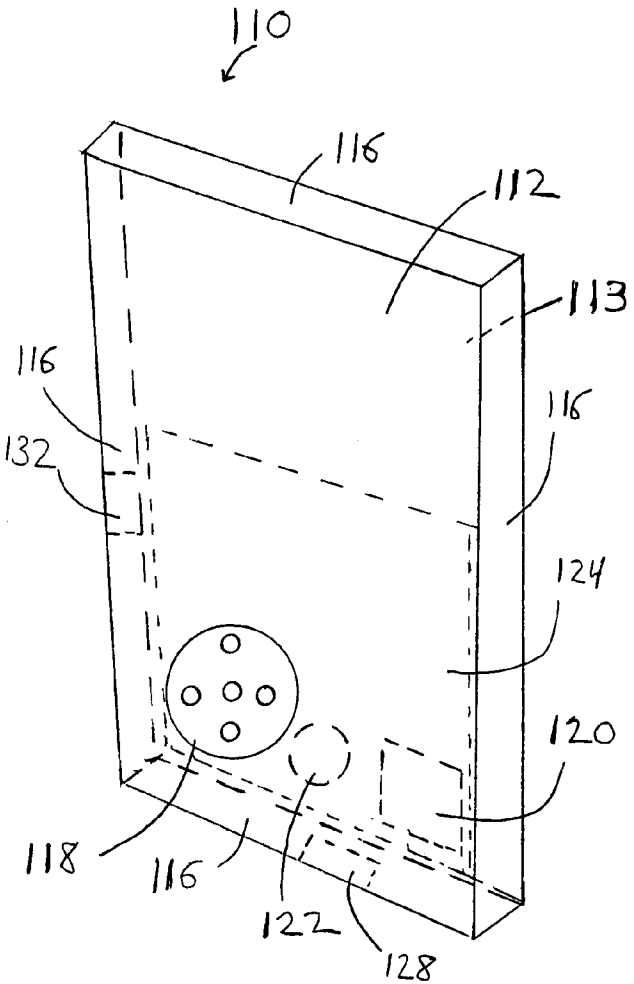
FIG. 3 is an exemplary perspective diagram of a housing of the communications device of FIG. 1.

Referring to FIGS. 1 and 3, the housing 110 has a thickness that is defined by the edges 116 such that the housing 110 includes an area between the first side 112 and the second side 113 to hold, for example, electronic components such as an input/output audio component 118 for enabling the recording and playing of sounds, a power source 120 to provide power to the other electronic components needing a power source, a switch 122 to initiate and stop the recording of sounds, and a processor 124 to control the recording and playing of sounds and other processing functions. Other items, such as, for example, self-adhesive labels may be attached to the first side 112, the second side 113, and the edges 116.

Switch 122 may be a hidden pressure-sensitive switch that, when depressed and held, initiates the processor 124 to begin recording sound through the input/output audio device 118 for storage in a memory device (not shown). Releasing the switch 122 may stop the recording process. In another implementation, depressing the switch 122 once and releasing the switch 122 may initiate the recording process, and depressing the switch 122 a second time may stop the recording process. Switch 122 is not visible when looking at the outside of the housing 110. In one implementation, switch 122 may be located by placing an indicator on the first side 112 of the housing 110 that marks the location of the hidden switch.

Figure 4:
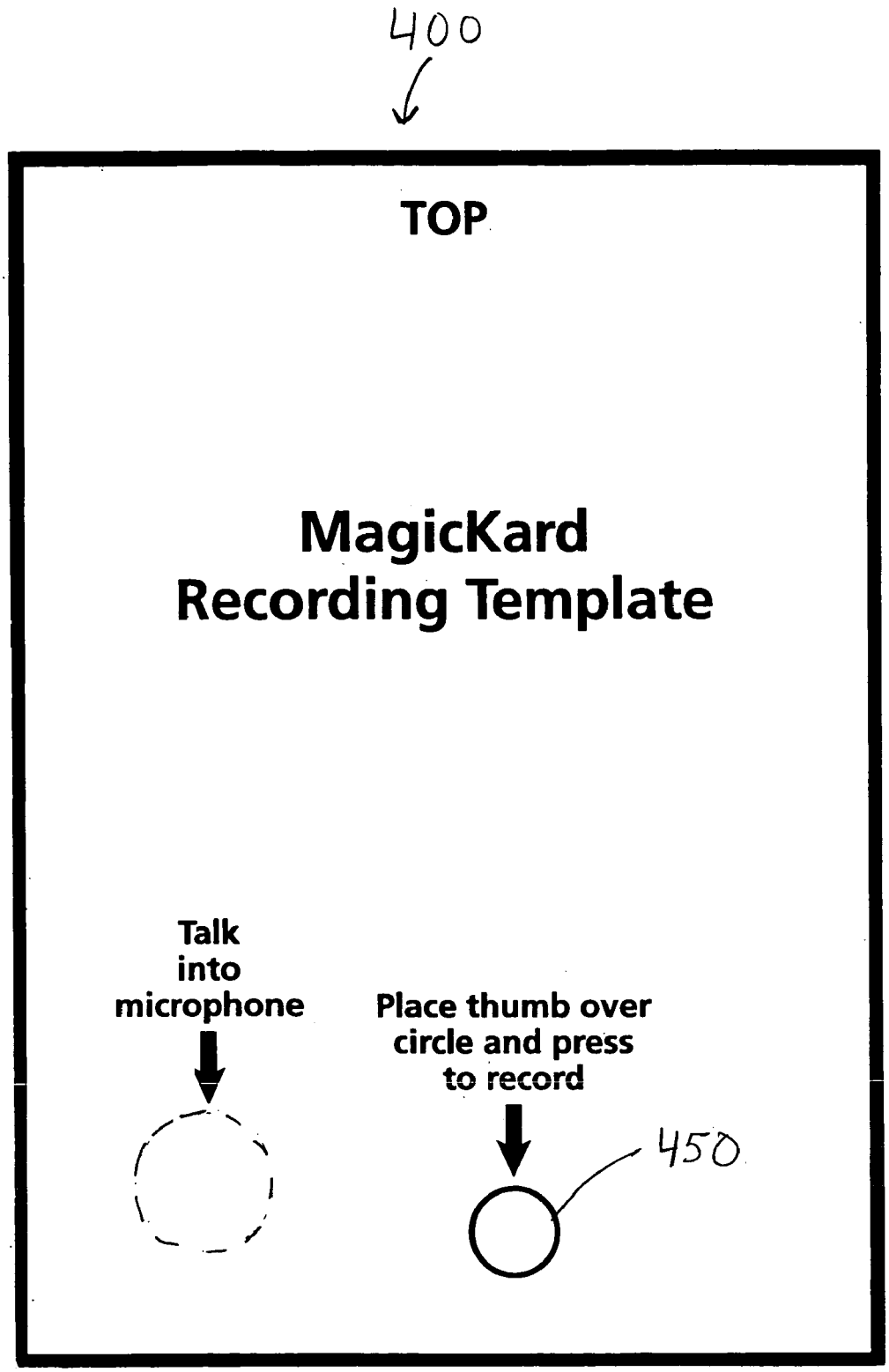
FIG. 4 is an exemplary diagram of a template.

Referring to FIG. 4, in another implementation, a template 400, such as, for example, a paper or clear plastic template, may be used to locate the hidden pressure switch 122. By not placing a visible indicator on the first side 112 of the housing 110, more space is available on the first side 112 to include text and/or graphics. A visible indicator on the first side 112 of the housing 110 may visually interfere with the message that the communications device 100 is intended to convey. The template 400 also may be used to protect the housing 110 and any visual messages that may be affixed to the housing 110 from dirt, smudges, fingerprints, and the like.

Housing 110 includes a first opening 128 that provides access to the electronic components. For example, the first opening 128 may provide access for a connector to connect to the processor 124 to enable sounds to be transferred from a device containing sounds to the communications device 100. Housing 110 also includes a second opening 132 that enables an activation tab 134 to activate and stop the playing of sounds. The activation tab 134 connects to the electronic components housed within the housing 110 and to the panel 105. When panel 105 is opened, the activation tab 134 is pulled, thus playing any sounds stored in the electronic components of the housing. When the panel 105 is closed, the activation tab 134 is pushed, thus stopping any sounds that may have been playing. By using an activation tab 134 that comes out of the opening 132 on one of the edges 116 to start playing the sounds, more space is available for text and/or graphics on the first side 112 of housing 110. The sound stored in the communications device 100 may be repeatedly played by opening and closing the communications device 100.

Figure 5:
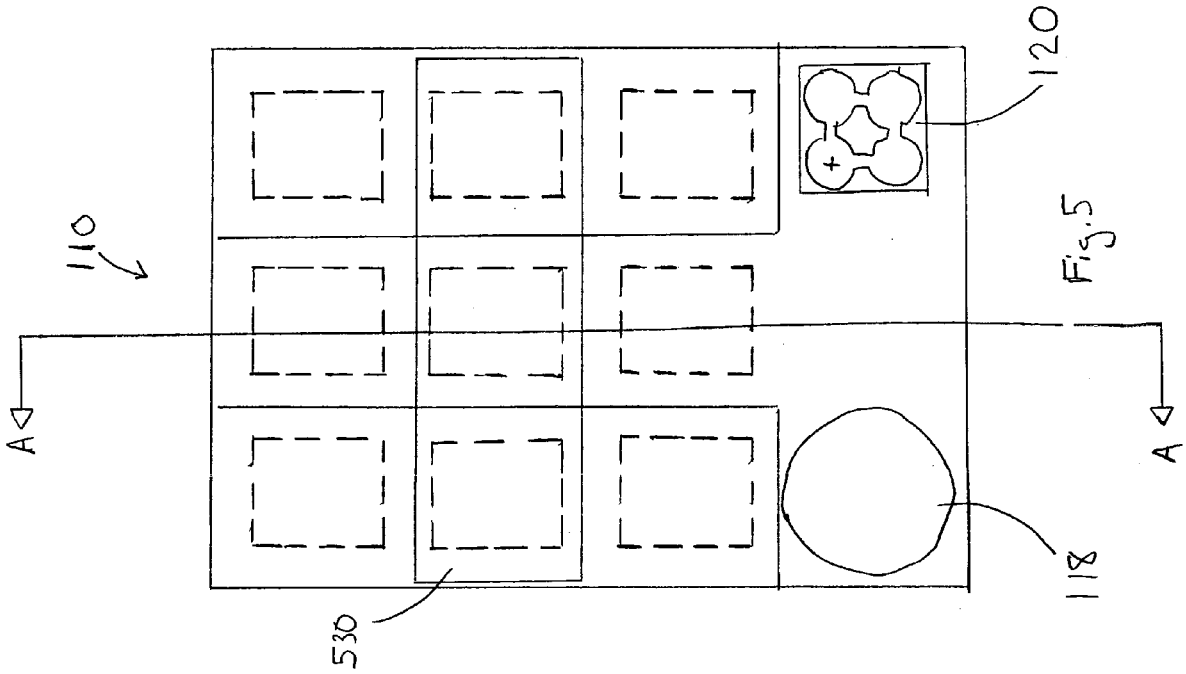
FIG. 5 is an exemplary diagram of the housing of the communications device of FIG. 1.

In one exemplary implementation, the housing 110 may be constructed of a durable material such as, for example, heavy cardboard or plastic, to prevent damage to the electronic components housed within the housing 110. Referring to FIG. 5, the housing 110 may include an internal grid-like structure 530 to provide sturdiness and support to the housing 110 so that electronic components, such as, input/output audio device 118 and power source 120 may be protected. In one implementation, the grid-like structure may include a rectangular grid of plastic I-beams. The top and bottom of the I-beams provide a flat surface to attach card stock. In this way, it may be easier to mount custom-printed text and/or graphics to the housing 110 by using for example, self-adhesive-type labels. The hollow grid-like structure 530 also may amplify the sound produced from speaker 118.

Figure 6:
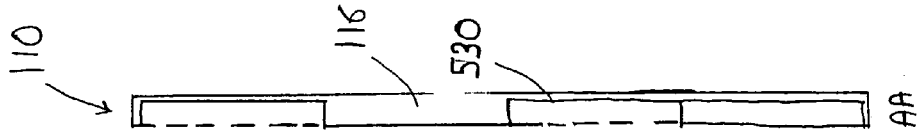
FIG. 6 is a cross-section view of the housing of FIG. 5.

FIG. 6 is a cross section of the housing 110 and illustrates one of the edges 116 and the grid-like structure 530. The grid-like structure 530 may be made of plastic or other similar type material. Referring back to FIGS. 1 and 3, the first side 112, the second side 113, and the edges 116 may be made of a solid plastic or cardboard that surround the internal grid-like structure 530. In conventional cards, the electrical and other components are placed between two attached pieces of card stock that create a bulge in the middle. The bulge may be visually unattractive and when adhesive labels are attached to the curved bulge, creases and air bubbles may appear. By using housing 110, the perceived value to consumers is increased and the life of the card and the electronic components are extended.

Figure 7:
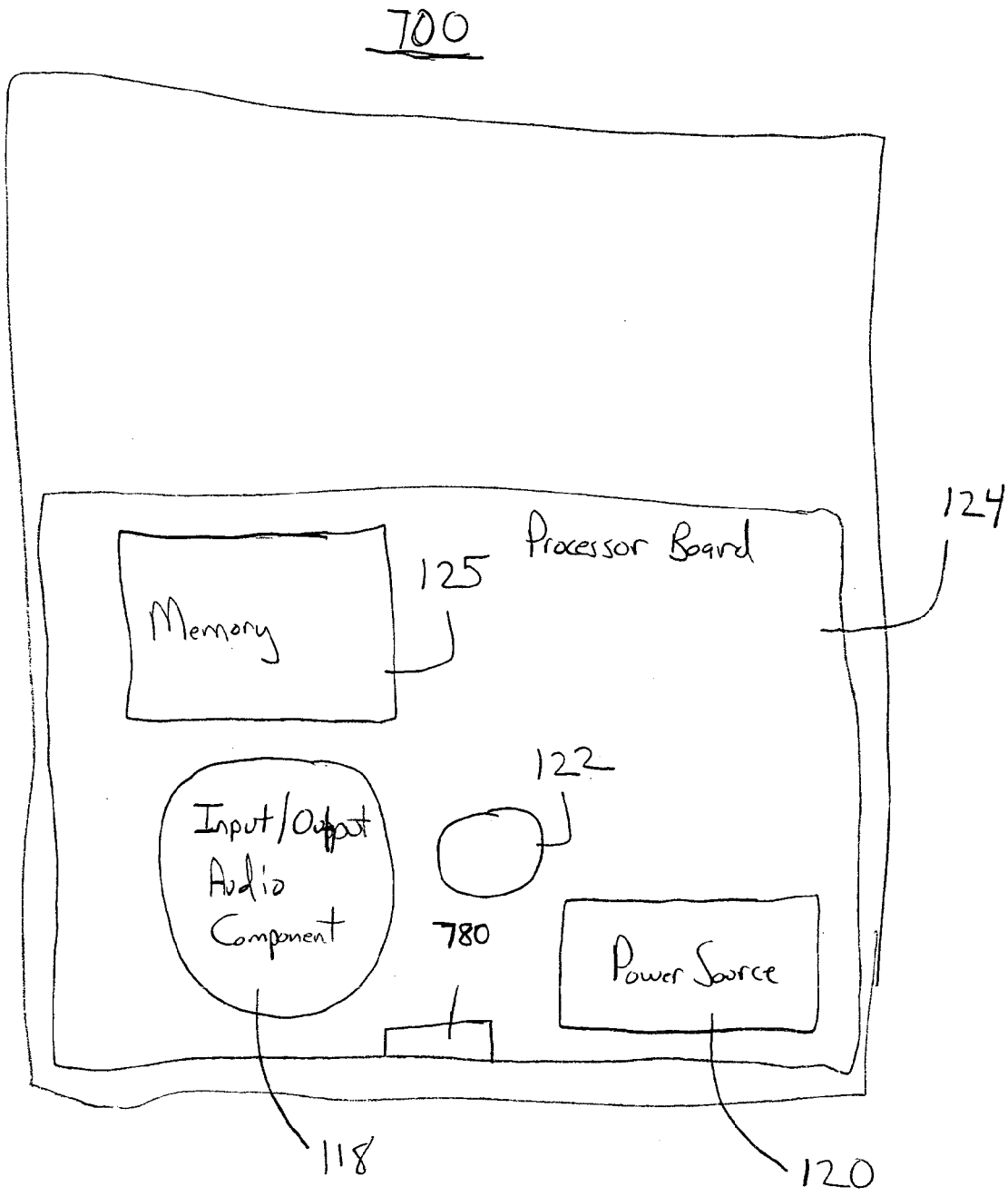
FIG. 7 is a block diagram of electronic components of the communications device of FIG. 1.

Referring to FIG. 7, a block diagram of the electronic components 700 housed within the housing 110 are illustrated. The electronic components 700 typically include input/output audio component 118, power source 120, switch 122, processor 124, and memory 125. The input/output audio component may function as a microphone to receive audio that is stored in memory 125 and also may function as a speaker to play the audio sounds that are stored in memory 125.

In one implementation, the input/output audio component 118 may be affixed to a card stock that is attached to the second face 112 of the housing 110. When the input/output audio component 118 functions as a speaker, this creates an acoustic suspension speaker assembly that results in an increased volume of sound and bass response and improves the overall sound quality.

Power source 120 may include a battery, such as, for example, micro alkaline battery cells, to provide power to processor 124 and the other electronic components 700.

Processor 124 may include a port 780 such that a connector may be attached to the processor 124 to process audio signals received from another device to store in memory 125. For instance, audio may be downloaded from a personal computer, a personal digital assistant (PDA), an analog or digital recording device, or other audio type devices to the communications device 100 for storage in memory 125 for subsequent playback using the communications device 100.

In another implementation, audio may be recorded directly to the communications device 100 by depressing switch 122 to activate the recording process, recording sound received through the input/output audio component 118, and processing the sound by processor 124 for storage in memory 125 for subsequent playback through the input/output audio component 118.

In one implementation, processor 124 may include automatic audio modulation circuitry to enable two sounds to be played at the same time, with one of the two sounds taking precedence over the other sound. For example, one sound may include music and the second sound may include audio of a voice that is to be played at the same time as the music but take precedence over the music. When an audio signal from a voice message is detected, the background audio signal may automatically be lowered to a predetermined lower level (e.g., 25% of the maximum level). In this way, the music plays in the foreground, at which time it is relegated to a background level (e.g., a default setting at a predetermined reduced volume). This can happen as many times as necessary such that the two audio signals do not interfere with each other, but rather complement each other. In addition, damping circuitry also may be utilized such that the required volume changes are instituted smoothly, thus producing a more pleasant sound.

In one implementation, communications device 100 may be used to communicate a message that includes a visual and/or an audio message. Communications device 100 is a self-contained communications device 100 such that one person can communicate a visual and an audio message to another person simply by affixing or having affixed the desired visual message to the communications device, recording or downloading the audio message to the device, and handing the communications device 100 to the other person. The person receiving the communications device 100 perceives the visual message by reading the message and perceives the audio message by opening the panel 105, which causes the activation tab 134 to initiate the playing of the audio message. The person receiving the communications device does not require any additional tools or devices to listen to the audio message. The person may play the audio message an almost indefinite number of times simply by opening the communications device 100, listening to the audio message, closing the communications device 100, and re-opening the communications device 100 to start the playing of the audio message again.

Figure 8:
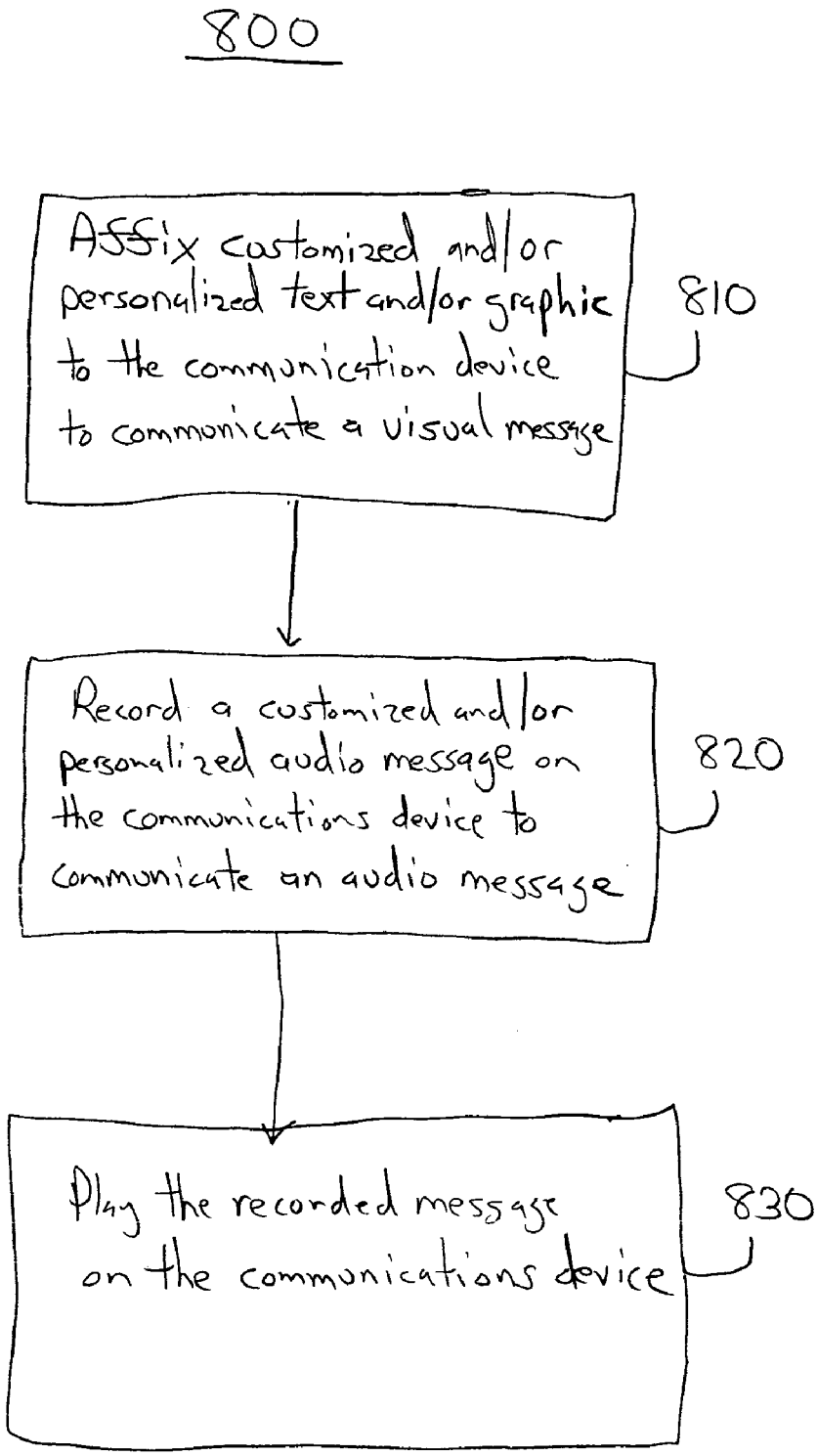
FIG. 8 is a flow chart of an exemplary process of using the communications device of FIG. 1.

Referring to FIG. 8, using the communication device as a communication tool 800 includes affixing to the communications device customized text and/or graphics that communicate a visual message (step 810), using the communications device to record a message on the communications device to communicate an audio message (step 820), and using the communications device to play the recorded message (step 830).

Figure 9A:
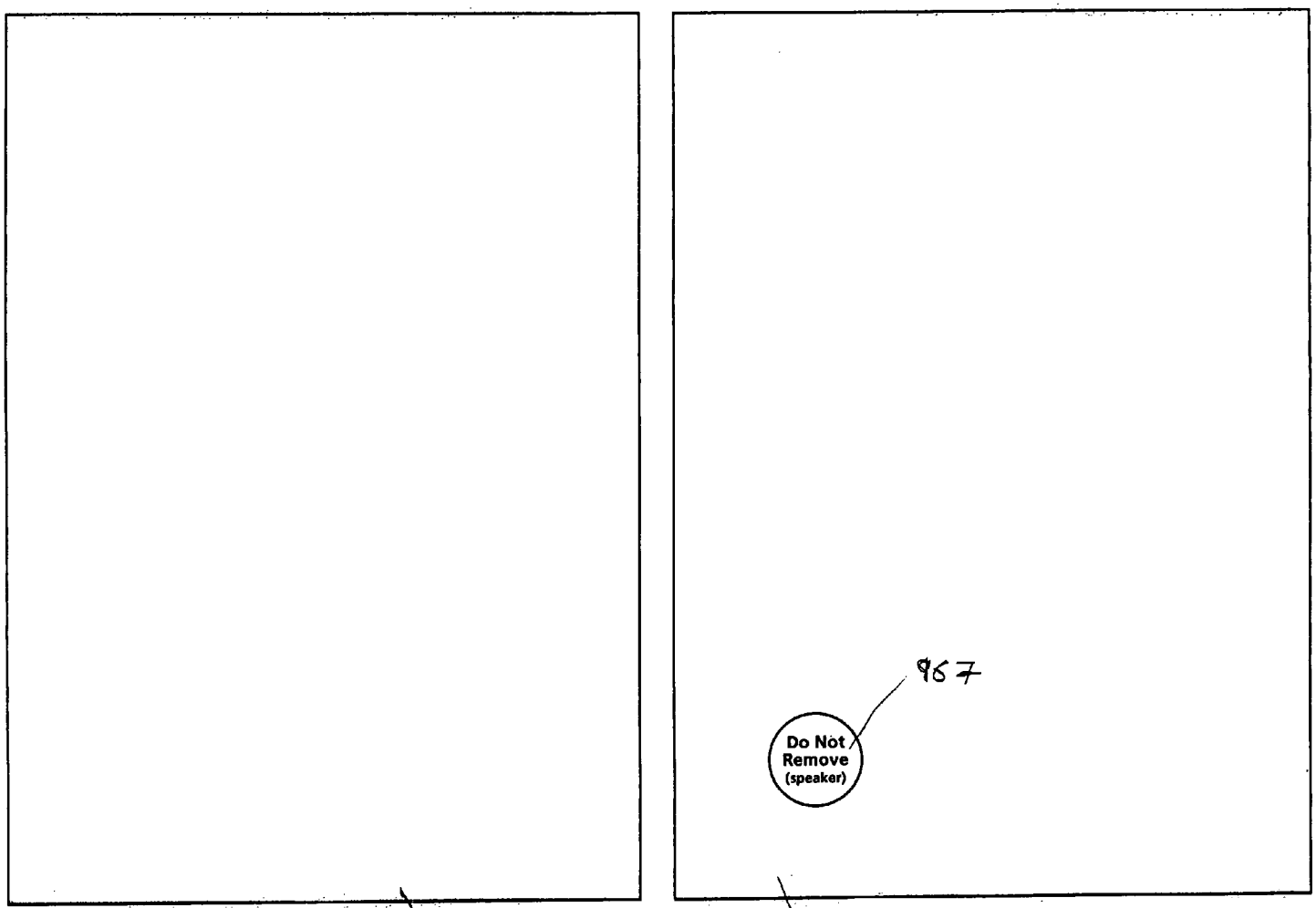
FIGS. 9*a*–9*c* are exemplary diagrams of labels to affix to the communications device of FIG. 1.
Figure 9:
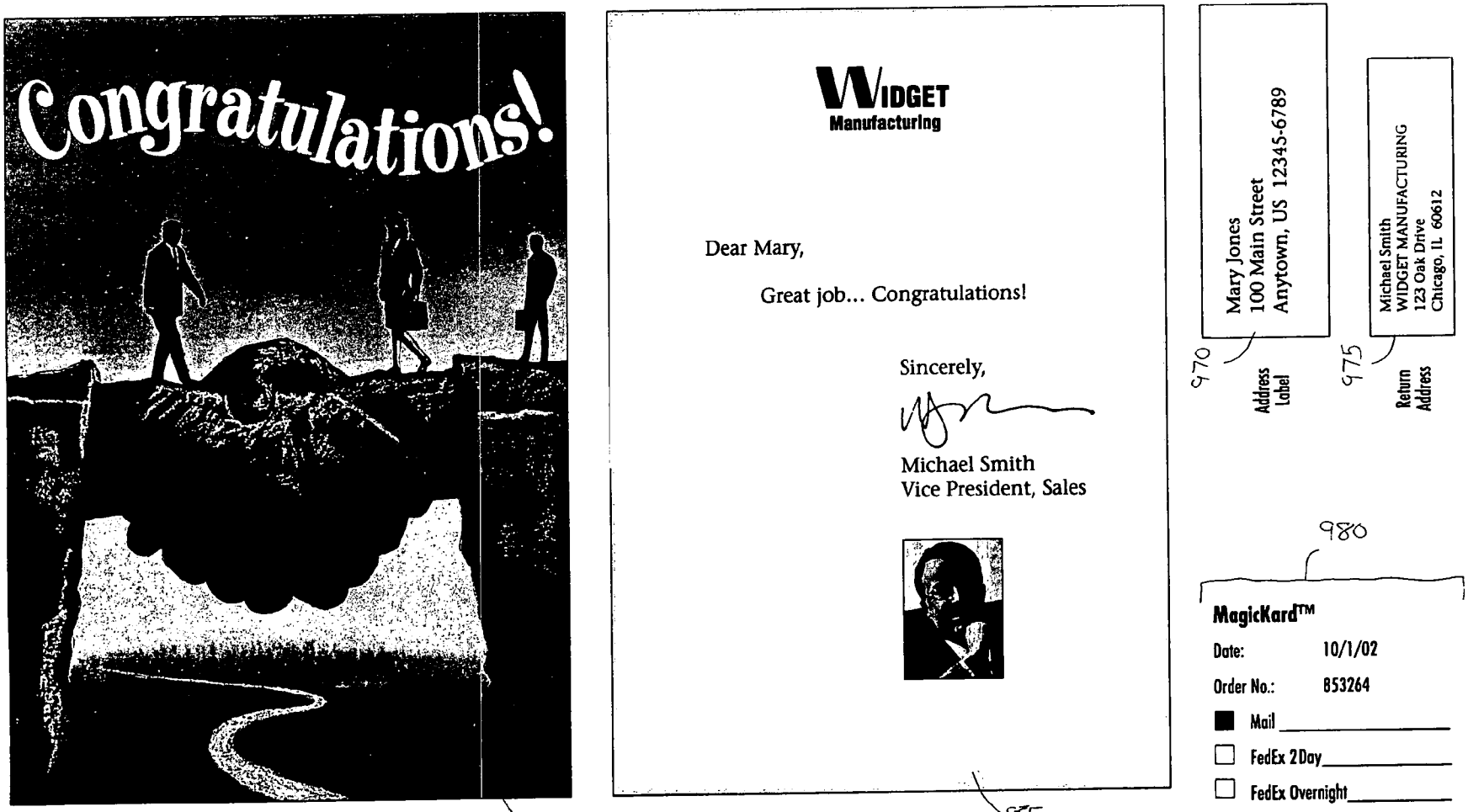

The communications device may be completely personalized using customized text and/or graphics (step 810). There are several ways to customize the communications device with text and/or graphics. In one implementation, the text and/or graphics may be designed on a personal computer using a text editing and/or graphics software application and printed on pre-scored sheets of self-adhesive labels. Referring to FIG. 9*a*, a first customized self-adhesive label 960 may be printed and affixed to the front face 107 of the panel 105 and a second customized self-adhesive label 965 may include a hole 967 cut out for the speaker and may be printed and affixed to the first side 112 of the housing 110. Similarly, the exemplary self-adhesive label 960 and 965 may be printed and affixed to the other surfaces of the communications device 100.

Referring to FIG. 9*b*, exemplary customized labels 960 and 965 are illustrated. In this example, customized label 960 may be affixed to the front face 107 of the panel 105 that provides information about a particular product. In this example, customized label 965 includes customized and personalized information about the sales representative. Customized label 965 may be affixed to the first side 112 of the housing 110 such that when the communications device 100 is opened the label 965 is visually perceived. At the same time the sales representatives customized information is visually perceived, an audio message customized by the sales representative begins to play when the communications device 100 is opened. The print area for customized label 960 may intentionally be larger than the area that is pre-scored to remove the label. Having the print area for the label a little larger than the label area creates bleed, which allows for different printer alignments and offsets.

Referring to FIG. 9*c*, in addition to customized labels 960 and 965, the sheet may include an address label 970, a return address label 975, and order information 980. The address labels 970 and 975 may be self-adhesive labels that are easily removed from the sheet and affixed to an envelope, box, or other mail packaging so that the communications device may be mailed to a designated recipient. Including the labels 970 and 975 is useful when a person orders a communications device 100 over the Internet and customizes the visual message using a designated website. Once the order is placed over the Internet, the customized labels 960 and 965 may be printed out at a location that receives the order and the labels 960 and 965 may be affixed to the device. The address labels 970 and 975 may be printed on the same sheet and removed and affixed to a mail packaging for mailing to the designated recipient.

In another implementation, a website on the Internet may be accessed and the website may be used to design the text and/or graphics that are to be used on the communications device 100. For example, a person wishing to communicate the message using the communications device may browse to a website that is structured and arranged to accept the desired text message and format the message as it will look on the self-adhesive labels. The website may include suggested templates and graphics (e.g., clip art) or the user may completely design their own. The self-adhesive labels may be printed directly from the website or an order may be placed through the website such that the labels are printed, affixed to the communications device and mailed to the user.

In another implementation, the person wishing to communicate the message may provide a design for someone else to create the text and/or graphics and to print the self-adhesive labels. Thus, the customized text and/or graphics can be ordered and printed in bulk, affixed to the communications device, and sent to the person in a state ready to be used.

The communications device may be used to record a customized and/or personalized audio message (step 820). There are several ways that a user may record an audio message to the communications device. In one implementation, the user may call a telephone number (e.g., a toll free telephone number) and use an interactive voice response system to record the audio message that the user wants on the communications device. The recorded audio message may be downloaded and stored on one or more communications devices.

In another implementation, the user may use a microphone through a personal computer or other computing device and record the audio message and save it to the memory on the personal computer. The audio message may be downloaded from the memory on the personal computer to the memory 125 on the communications device 100 by using a connector through port 128. The user may download the same audio message to one or more communication devices.

In another implementation, the user may select a pre-recorded message to be used on the communications device. For example, the user may select the pre-recorded message by using the telephone and selecting the message from a menu of pre-recorded messages or the user may select the pre-recorded message by browsing to a website and selecting the message from a menu of pre-recorded messages on the website.

In yet another implementation, the user may use a microphone that is built into the communications device 100 that is part of the input/output audio component 118. As discussed above with respect to FIGS. 1–3, the user may begin recording by depressing switch 122 and speaking into the input/output audio component 118.

The different methods for recording and storing an audio message on the communications device 100 may be used alone or in combination. For example, the user may select a pre-recorded message from a website and the message may be downloaded and stored on the communications device. The user also may record a message on that communications device using the built in input/output audio component 118. The second audio message may be in addition to the pre-recorded message (e.g., added to the end of the pre-recorded message), it may replace the pre-recorded message, or it may complement the pre-recorded message (e.g., the pre-recorded message may be background music and the second audio message may be a voice message that is played at the same time as the background music).

The communications device 100 may be used for many purposes. The exemplary implementations provided below are not meant to limit the uses and methods of using the communications device 100, but are provided as exemplary illustrations of several uses of the communications device 100.

In one exemplary implementation, the communications device 100 may be used as a marketing tool to market a product. The communications device 100 is an ideal marketing tool because it is a self-contained device that does not require the customer or potential customer to use any additional equipment (e.g., a tape cassette player, a computer, a video cassette player, a digital video disk player, or a compact disk player) to visually and audibly perceive the message being communicated. The communications device 100 is also an ideal marketing tool that enables a sales representative still to communicate a visual and audio message about a product to a customer or potential customer even when the sales representative does not get to meet and speak with the person directly. This is effective in still reaching hard-to-reach customers or "no see" customers with a visual and an audio message about the product and the sales call. Another benefit of the communications device 100 is that it may be mass-produced with the customized visual and audio messages. The communications device 100 may be completely personalized for the individual sales representative, because it may include the sales representative's photograph, signature, voice, and personal text message. The communications device 100 also may reduce marketing costs by reducing the number of sales calls that need to be made. For example, travel and wait time may be eliminated, and thus, the productivity of the sales representative may be increased.

The communications device 100 may be completely customized and tailored for particular products and even for particular customers. For example, the visual message may be customized for a particular product by designing the self-adhesive labels to be attached to the communications device 100 as discussed above. One advantage of designing the labels using a website, is that once the labels are designed they may be printed in bulk and attached to the communications device 100. The visual message may include information about the product and contact information and other information about the sales representative including a photo of the sales representative.

The audio message may be customized by the sales representative in different ways that apply to customizing an audio message for a single communications device and to customizing an audio message that is to be used on multiple communications devices. For example, if the sales representative wants an audio message on a single communications device or the same audio message on multiple communications devices 100, then the sales representative may call a toll-free telephone number and record the message using an interactive voice recording system and the message is downloaded to multiple communications devices 100 from the interactive voice recording system. Alternatively, the sales representative may use a web site that is structured and arranged to record an audio message and the recorded audio message may be downloaded to one or more communication devices 100. In another implementation, the sales representative may record the audio message onto a personal computer using recording software and then download the audio messages to one or more communications devices 100.

If the sales representative wants to record over a previously recorded audio message or to record an audio message "on-the-spot" on the communications device 100, then the sales representative may record a message directly on the communications device by depressing the hidden pressure-sensitive switch to activate the recording process and record the message. When the customer opens the communications device 100, the audio message is played. One benefit of recording the audio message directly to the communications device 100 is that the sales representative can record the audio message from anywhere "on-the-spot" without the need for any additional equipment to record the audio message. For instance, the sales representative may be in the customer's office and can record a personal, customized audio message to leave with the customer if they are too busy to meet with the sales representative or the audio message may be recorded after meeting with the customer, for example, to provide additional information and to tell the customer thanks for the opportunity and then left with a receptionist for the customer to listen to at a later time. The customer is able to listen to the audio message without the use of any other equipment.

In one implementation, the audio message may be recorded directly into the communications device 100 even if the device was originally mass-produced with the same audio message on numerous communications devices. The audio message that is directly recorded into the communications device 100 may be in addition to the mass-produced audio message or it may replace the mass-produced audio message by recording over the mass-produced audio message.

After the visual and audio messages have been created and associated with the communications devices 100, the devices may be shipped to the sales representative so that the sales representative can give them directly to the customer. Additionally and/or alternatively, the communication devices 100 may be mailed directly to the customers of the sales representative by printing out mailing labels on the label sheets, as illustrated in FIG. 9*c*, or by printing out mailing labels separate from the label sheets. By having the labels on a single sheet, as in FIG. 9*c*, it is less likely that the customized communications device 100 will be mailed to the incorrect location.

Direct mailing of the communications device 100 to customers provides the benefit of reducing the number of sales call made by the sales representative, especially for sales calls that are in remote locations or are with customers that are typically "hard-to-see" or who will not meet with sales representatives. In one implementation, the sales representative may use a combination of sales calls and direct mailings of the communication device 100.

In a specific exemplary implementation, the communications device 100 may be used as a marketing tool by a pharmaceutical sales representative. For example, the pharmaceutical sales representative may use the communications device 100 to market one or more particular drugs and/or medical devices to doctors and other customers. In this context, the communications device 100 is effective to reach "hard-to-see" or no-see" doctors that do not make themselves available to sales representatives. The device 100 is also effective in providing additional information to doctors about the particular aspects of the drug such as its clinical pharmacology, medical uses, warnings, precautions, advantages, and/or benefits after meeting with the sales representative. After meeting with the doctor, the device 100 may be left behind with a personalized message from the sales representative to the doctor to thank the doctor for their time, to reinforce the message delivered by the sales representative to the doctor, and/or to highlight key points and features about the particular product.

With respect to the visual message, the communications device 100 may include customized text and/or graphics about the particular drug and/or medical device that are attached to the front face 107 of panel 105 and the first side 112 of housing 110. Attachment 211 may be attached to the inside face 109 of panel 105, which may include a holder 213 for additional visual material.

In one exemplary implementation, a multi-panel brochure discussing the particular drug and/or medical device is attached to the inside face 109 of panel 105 and a technical, clinical removable pamphlet may be placed in holder 213. Referring to FIG. 10, the pamphlet 1000 may include a table of contents 1010 that makes it easy for the doctor to find a particular section of the clinical pamphlet. The pamphlet 1000 may include a user-friendly saddle stitch booklet format that is easy to use and is easy to find a desired section. Conventional technical descriptions of drugs that are typically included in drug packaging are not organized by using a table of contents and are typically a single sheet of paper that has been folded (e.g., like a roadmap) and that is not user-friendly for finding desired information or for refolding. By using a table of contents 1010 and a user-friendly saddle stitch booklet format, it is much easier for a doctor, a pharmacist, and/or a patient to locate the desired information in the pamphlet.

Other exemplary implementations may include using the communications device as a marketing tool for a real estate agent to market a house, selling automobiles (e.g., used as a thank you to a customer for test driving an upscale automobile), thanking a guest for staying at a hotel, marketing financial services, marketing computer software products, and marketing other products. The communications device also may be sold as a souvenir to memorialize an event or a visit to an attraction. For example, the customized visual message may include a photograph of a person attending an event or visiting an attraction and the person also may include a customized audio message.

In one exemplary implementation, the communications device 100 may be used by a doctor to communicate a message to a patient. For example, in one implementation, the doctor may prescribe a particular drug to a patient. The communications device 100 may include a visual message about the particular drug and personalized visual information about the doctor, such as, for example, contact information, photograph, signature, as well as other information. The doctor may record a personalized audio message to the patient that may include information about the prescription such as, dosage information, frequency of taking the prescription, and other information. Using the communications device 100 in this manner may be useful to assist certain patients, such as, for example, visually impaired patients, mentally challenged patients, and forgetful patients.

The communications device 100 is also useful for a doctor to give instructions to a patient and their family, especially when the patient receives traumatic news during the doctor's visit. At a time when traumatic news is received, the patient may not comprehend information and/or instructions that the doctor tells the patient. To assist in this situation, the doctor may record a personalized audio message directly into the communications device 100 that provides important information to the patient and their family that the patient can listen to repeatedly at a later time.

In one implementation, the communications device 100 may first be used as a marketing tool by a sales representative to a doctor and then may be used by the doctor as a communications tool to the patient. For example, the sales representative may give the communications device 100 to the doctor, where the communications device 100 includes a customized visual message about a particular prescription drug and information about the sales representative. An attachment with additional information about the drug may be affixed to the inside face of the panel. The communications device 100 also may include a customized audio message that was recorded by the sales representative for the doctor to hear. After the sales representative gives the communications device 100 to the doctor, the doctor may customize the communications device to give to a particular patient. For instance, the customized visual message that contained personal information about the sales representative may be depicted on a peel-off label that is affixed to either the panel 105 or the housing 110. A customized visual message that includes personal information about the doctor may be affixed beneath the peel-off label that includes the visual message from the sales representative. Thus, the doctor simply has to remove the peel-off label containing the information about the sales representative to reveal the customized personal information about the doctor. Then, the doctor may record a customized audio message for a particular patient that replaces the audio message recorded by the sales representative. For instance, the doctor may use the template 400 to locate the hidden pressure-sensitive switch 122 to initiate the recording process. Thus, the patient receives customized visual information about the drug, a customized visual message from the doctor and a customized audio message from the doctor that may include specific instructions from the doctor to the patient.

In another exemplary implementation, after the sales representative gives the communications device 100 to the doctor, the doctor may use a customized peel-off adhesive label that includes the doctor's personalized information and that can be affixed over the sales representatives information. The doctor can record a personalized audio message directly into the communications device 100 that replaces the audio message of the sales representative.

In the exemplary implementations described above with respect to the sales representative, the doctor and the patient, the communications device 100 is capable of multiple uses and may be reused multiple times to enable a receiver of the communications device to customize the communications device with a different customized visual and audio message, that either supplements or replaces the existing visual and audio messages, and to deliver the communications device 100 to another recipient.

In another implementation, the communications device 100 may be used by a person to give a gift (e.g., a gift certificate, tickets, passes, coupons, or other similar items) to another person by inserting the gift in a holder 213 affixed to the communications device 100. The gift giver may customize a visual message that may be affixed to the panel 105 and/or the housing 110 of the communications device 100. The gift giver may record a customized audio message for storage on the communications device 100 for subsequent hearing by the person receiving the gift.

In one exemplary implementation, an actor, celebrity, sports figure, head of a company, or other person of prominence (hereinafter "celebrity") can contribute to the audio message in any one of a number of ways. For example, the celebrity can prerecord an audio message that comprises the entire audio message that is stored on the communications device for subsequent playing by the gift receiver. In another example, the celebrity can prerecord an audio message that can then be combined with the audio message of the gift giver. The two audio message are played consecutively so it appears as if there is just a single audio message, where the celebrity and the gift giver recorded the message at the same time. In another instance, the celebrity can prerecord a number of different audio messages that would be appropriate for various occasions such as, happy birthday, congratulations, happy mother's day, merry Christmas, and others. One of the prerecorded audio messages can be combined with the audio message of the gift giver and stored on the communications device and given to the gift receiver for subsequent hearing by the gift receiver.

Using the communications device 100 in this manner, for example, is one way for an employer to recognize an employee. The employer may enclose a gift in the communications device 100, where the communications device is visually customized and there is a personal audio message from the employer to the employee. The employer's audio message may be combined with a prerecorded audio message from a celebrity.

The described systems, methods, and techniques may be implemented in digital electronic circuitry, computer hardware, firmware, software, or in combinations of these elements. Apparatus embodying these techniques may include appropriate input and output devices, a computer processor, and a computer program product tangibly embodied in a machine-readable storage device for execution by a programmable processor. A process embodying these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially-designed ASICs (application-specific integrated circuits).

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims. For example, instead of attaching self-adhesive labels that include customized and personalized information to the front face 107, the inside face 109, and/or the rear face 114, the customized and personalized information may be printed directly on the different faces of panel 105. For instance, the information may be printed on panel 105 and then attached to housing 110. Then, the only self-adhesive labels that need to be printed are the ones that would be affixed to the first side 112 of the housing 110.

In another exemplary implementation, a push-button-type switch may be used to start and stop the playing of sounds from the communications device 100. For example, the switch may protrude from the first side 112 of housing 110 such that when the panel 105 is opened away from housing 110 the switch extends and the sound starts playing. When the panel 105 is closed flush against housing 110, the switch is depressed and the sound stops playing. Other types of switches may be used as well including a slide switch that includes an "on" and an "off" position.

What is claimed is:

1. A communications device, comprising:

a panel having at least a front face and an inside face;

a housing having a front side, a rear side, and multiple edges, wherein the panel is affixed to the housing such that the inside face of the panel can be folded flush against the front side of the housing;

one or more electronic components housed within the housing, wherein the electronic components include, a switch that when depressed initiates a recording process to record an audio message;

a memory to store the audio message for repeated playing;

a processor;

a power source; and an input/output audio device to record and play the audio message;

an attachment affixed to the inside face of the panel, wherein the attachment includes a multiple-page attachment; and a holder affixed to a page of the attachment.

2. The communications device of claim 1 wherein the holder is clear to enable visual perception of an item in the holder.

3. The communications device of claim 1 wherein the attachment includes a multiple-page booklet.

4. The communications device of claim 1 wherein:

the attachment includes a multiple-page fold-out booklet, and the holder is affixed to a last page of the booklet and is clear to enable visual perception of an item in the holder.

5. A communications device, comprising:

a panel having at least a front face and an inside face;

a housing having a front side, a rear side, and multiple edges, wherein the panel is affixed to the housing such that the inside face of the panel can be folded flush against the front side of the housing;

one or more electronic components housed within the housing, wherein the electronic components include, a switch that when depressed initiates a recording process to record an audio message;

a memory to store the audio message for repeated playing;

a processor;

a power source; and an input/output audio device to record and play the audio message; and an attachment affixed to the inside face of the panel, wherein the attachment includes a multiple-page attachment, wherein the housing further includes an opening to enable a connector to connect to the processor to transfer an audio message from another device to the processor for storage in the memory.

6. The communications device of claim 5 wherein the panel is made of card stock.

7. The communications device of claim 5 wherein the housing is made of plastic.

8. The communications device of claim 5 wherein the attachment includes a multiple-page booklet depicting a visual message providing information about a product.

9. The communications device of claim 5 wherein the attachment includes a multiple-page fold-out booklet.

10. The communications device of claim 5 wherein the attachment includes a multiple-page fold-out booklet depicting a visual message providing information about a product.

11. The communications device of claim 5 further comprising a holder affixed to the inside face of the panel.

12. The communications device of claim 11 wherein the holder is clear to enable visual perception of an item in the holder.

13. The communications device of claim 5 further comprising an activation tab that is affixed to the inside face of the panel such that when the panel is opened away from the housing the activation tab initiates playing of the audio message.

14. The communications device of claim 5 wherein a location of the switch is not visibly perceivable.

15. The communications device of claim 5 further comprising a template to locate the switch to initiate recording of the audio message.

16. The communications device of claim 5 further comprising a visual message that is affixed to the panel and the housing.

17. The communications device of claim 16 wherein the visual message is depicted on one or more labels that are affixed to the panel and the housing.

18. The communications device of claim 16 wherein the visual message is depicted on one or more self adhesive labels that are affixed to the panel and the housing.

19. The communications device of claim 16 wherein the visual message is depicted on one or more cards and the cards are affixed to the panel and the housing.

20. A communications device, comprising:

a panel having at least a front face and an inside face;

a housing having a front side a rear side, and multiple edges, wherein the panel is affixed to the housing such that the inside face of the panel can be folded flush against the front side of the housing;

one or more electronic components housed within the housing, wherein the electronic components include, a switch that when depressed initiates a recording process to record an audio message;

a memory to store the audio message for repeated playing;

a processor;

a power source; and an input/output audio device to record and play the audio message;

an attachment affixed to the inside face of the panel, wherein the attachment includes a multiple-page attachment; and a visual message that is customized on a computing device and printed on a sheet containing a first self-adhesive label that depicts a first portion of the visual message and that is affixed to the panel and a second self-adhesive label that depicts a second portion of the visual message and that is affixed to the housing.

21. A communications device, comprising:

a panel having at least a front face and an inside face;

a housing having a front side, a rear side, and multiple edges, wherein the panel is affixed to the housing such that the inside face of the panel can be folded flush against the front side of the housing;

one or more electronic components housed within the housing, wherein the electronic components include, a switch that when depressed initiates a recording process to record an audio message;

a memory to store the audio message for repeated playing;

a processor;

a power source; and an input/output audio device to record and play the audio message;

an attachment affixed to the inside face of the panel, wherein the attachment includes a multiple-page attachment; and a first visual message that is depicted on a first self-adhesive label and affixed to at least one of the panel and the housing and a second visual message that is depicted on a second self-adhesive label and that differs from the first visual message and is affixed over the first self-adhesive label such that the second self-adhesive label may be removed to reveal the first visual message depicted on the first self-adhesive label.

* * * * *